United States Patent [19]

Wechem et al.

[11] Patent Number: 5,054,458

[45] **Date of Patent: * Oct. 8, 1991**

[54] COMBUSTION ENGINE WITH FUEL INJECTION SYSTEM, AND A SPRAY VALVE FO R SUCH AN ENGINE

[75] Inventors: Guus V. Wechem; Gerrit Beunk; Fritz Van Den Elst, all of Holland; Philips M. Gerson, Velp-Holland, all of Netherlands

[73] Assignee: Texas Instruments Incorporated, Dallas, Tex.

[ * ] Notice: The portion of the term of this patent subsequent to Feb. 6, 2007 has been disclaimed.

[21] Appl. No.: 523,520

[22] Filed: May 15, 1990

Related U.S. Application Data

[60] Continuation of Ser. No. 370,519, Jun. 23, 1989, abandoned, which is a division of Ser. No. 55,481, May 28, 1987, Pat. No. 4,898,142.

[51] Int. Cl.[5] ..... F02M 31/00

[52] U.S. Cl. ..... 123/549; 123/557; 123/547; 239/533.12; 239/135

[58] Field of Search ..... 123/557, 549, 545, 547; 239/533.12, 135

[56] References Cited

U.S. PATENT DOCUMENTS

| | | | |
|---|---|---|---|
| 3,868,939 | 3/1975 | Friese et al. . | |
| 4,213,432 | 7/1980 | Levy . | |
| 4,235,210 | 11/1980 | Sumiyoshi et al. . | |
| 4,279,234 | 7/1981 | Marcoux et al. . | |
| 4,365,746 | 12/1982 | Tanasawa et al. . | |
| 4,447,706 | 5/1984 | Eder et al. . | |
| 4,458,655 | 7/1984 | Oza . | |
| 4,501,255 | 2/1985 | Van Der Ploeg et al. . | |
| 4,633,069 | 12/1986 | Berg et al. . | |
| 4,898,142 | 2/1990 | Van Wechem et al. | 123/557 |

FOREIGN PATENT DOCUMENTS

| | | |
|---|---|---|
| 2145153A | 3/1985 | United Kingdom . |

*Primary Examiner*—Andrew M. Dolinar
*Assistant Examiner*—M. Macy
*Attorney, Agent, or Firm*—James P. McAndrews; John A. Haug; Sharp, Melvin

[57] ABSTRACT

The invention relates to a combustion engine with fuel injection system, having at least one cylinder with an air inlet passage, into which passage opens a fuel spray valve which is connected to a fuel pipe with pump. Disposed in the fuel pipe or on the spray valve is a fuel heating element with which the infed fuel can come into direct contact.

10 Claims, 2 Drawing Sheets

COMBUSTION ENGINE WITH FUEL INJECTION SYSTEM, AND A SPRAY VALVE FO R SUCH AN ENGINE

This application is a continuation of application Ser. No. 07/370,519, filed 6-23-89, now abandoned, which was a division of application Ser. No. 07/055,481 filed May 28, 1987 now U.S. Pat. No. 4,898,142 issued Feb. 6, 1990.

BACKGROUND OF THE INVENTION

The field of this invention is that of combustion engines with fuel injection systems and relates more particularly to heaters for the fuel provided by such fuel injection systems.

Combustion engines with fuel injection are divided into engines with mechanical or electronic gasoline injection and diesel engines with injection of diesel fuel.

Compared with gasoline engines with a carburetor, an engine with fuel injection has the advantage that the fuel distribution is more efficient and that the engine reacts much more quickly and more accurately to changes in the position of the throttle, this being due to the short time elapsing between the movement of the throttle and the injection of the fuel. The power and acceleration are therefore clearly better in a fuel injection engine than in a carburetor engine. Electronic injection has the not inconsiderable advantage over mechanical injection that one can use temperature and pressure sensors to supply the cylinders with the correct amount of fuel in all circumstances. The quantity of fuel to be injected can be regulated by controlling the pressure (between, for example, 3 and 6 bars) or by regulation of the time. The outstanding advantages of fuel injection are offset by the disadvantage of a relatively poorer mixing of fuel and air; the air velocity is fairly low and there is little time available to mix fuel and air. Besides, the spray valve has a sparing spray action. These advantages are particularly felt when the engine is cold. The sparingly sprayed fuel, when poorly mixed with air, precipitates on the cold inlet passage and the cold cylinder wall.

BRIEF SUMMARY OF THE INVENTION

The object of the invention is largely to eliminate this disadvantage found with cold engines.

According to the invention, the engine referred to in the preamble is to this end characterized in that a fuel heating element is provided in the form of a thermistor of material with a positive temperature coefficient, said thermistor being connected to an electrical supply and discharge cable.

Through heating the fuel to a particular temperature (in gasoline engines, for example between 40° and 70 degrees C.) when the engine is cold, a much finer spray is obtained. It was also found that where there was spraying to particles under a certain size (about 12 microns) no precipitation occurred on the cold wall. The temperature will have to be kept under such control that vapour condensation does not take place. The correct temperature depends on the boiling range of the fuel in question and the minimum pressure occurring in the system. The winter grade is determinative, because it contains more volatile constituents. The great advantage of the thermistor of PTC material is that on electrical charging thereof the temperature cannot rise above a particular value depending on the chosen material, so that even without an advanced delicate control system the temperature of the thermistor remains with absolute certainty below the chosen value and the fuel temperature can also be selected to be below the value at which vapour condensation within the fuel injector takes place. It is known that the PTC material works on the principle that the electrical resistance at a particular temperature (for example, 80 degrees C.) has increased to such an extent that no further temperature increase occurs. PTC material has a very great energy density (watt/cu.cm) and has achieved its maximum temperature in a few seconds. PTC materials of varying composition and characteristics are described in U.S. Pat. No. 4,279,234 of Texas Instruments.

Through the direct contact between fuel and thermistor, the fuel will quickly and efficiently reach the desired temperature, in contrast to a system where one or more heating elements are provided round the fuel feed.

The heating of the fuel is of particular benefit when the engine is cold. For that reason, the electrical cables to and from the thermistor will preferably have a control system which is connected to a temperature sensor in the engine and which switches off or regulates the electric current to the thermistor when a particular engine temperature is reached.

Moreover, it is not beyond the bounds of possibility for the fuel heating also to be used when the engine is warm, in which case the thermostat either is not necessary or is incorporated in an advanced control system.

The PTC material can be of many different kinds. The heat transfer to the fuel will always have to be taken into consideration when deciding on the material. Realistic possibilities are lattice or honeycomb and porous types, where the fuel flows through the PTC element.

For the sake of compactness, strength, reliability and the possibility of efficient heat transfer to the fuel, it is preferable to use a holder which is disposed on the spray valve itself and has therein the thermistor in the form of a PTC tablet which is connected to a heat sink for transfer of heat to the fuel. The heat sink can be designed as a metal box with at least one fuel passage.

The fuel passages can run parallel to the central axis of the tablet and the holder, but it is more expedient to make the fuel passage in the form of a spiral which is located on the outer periphery of the box.

In the passage(s) the fuel will exhibit an essentially laminar flow pattern. In order to improve this, turbulence-generating raised parts and/or recesses are preferably disposed in the wall of the passage.

The heat transfer can be further improved by placing the PTC tablet between two heat sinks. The heat transfer path to be covered by the fuel is hereby extended.

Of course, it is important that the heat taken up by the fuel during its flow to the combustion chamber is released as little as possible to the environment. That is why the holder containing the PTC tablet and the heat sink is preferably thermally insulating and is positioned as near to the spray valve as possible. In this connection it can be advantageous to make the holder with thermistor integral with the spray valve. This combination then has a relatively small mass and is warmed more quickly. This design is particularly suitable for a pressure regulation of the injection system as compared to a timed system, because the injection valve with energizable solenoid needed for this has a large mass.

The invention can also be used for a diesel engine, where the injection pressure is much higher and the maximum admissible heating temperature of the fuel can be much higher than in the case of a gasoline engine.

Since the fuel heating element can be interposed in a line, a manufacturer of combustion engines will be able to accept the use of the present invention without any problem.

In the case of an engine with more cylinders, a number of heating elements can be connected to the same electrical system, for example by means of a bus-bar.

DESCRIPTION OF THE DRAWINGS

The invention will now be explained in greater detail with reference to FIGS. 1–4, in which example of embodiments are shown partially schematically.

DESCRIPTION OF THE PREFERRED EMBODIMENTS

Figure 1:
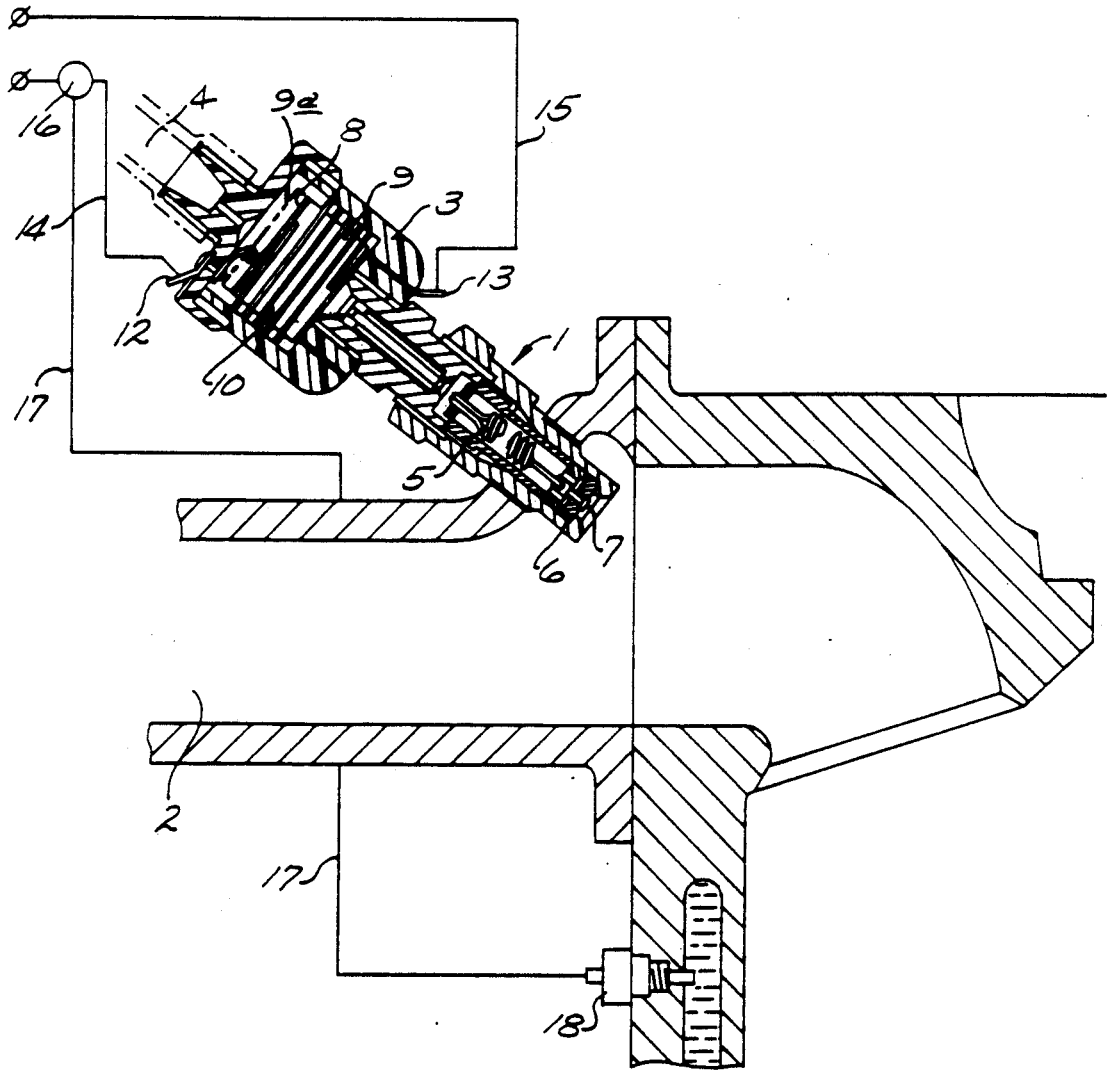

Referring to FIG. 1 the injection nozzle shown is fixed in a manner known per se in the wall of the schematically shown air inlet passage 2 in the cylinder head of gasoline fuel injection engine. This passage 2 is provided with an air filter (not shown) and a throttle valve (not shown) operated by the accelerator pedal. The injection nozzle 1 is connected by means of a holder 3 to a fuel pipe 4 with electric pump, which is not shown.

The injection nozzle is of known construction and comprises a valve element 7 pulled by a spring 5 on its seat 6. With a particular fuel pressure (for example, 3 atmospheres), the valve opens and fuel is sprayed into the inlet passage and mixes with air.

When the engine is cold a considerable improvement is achieved in this spraying if the fuel is heated to a temperature, say, between 40° and 70 degrees C. This heating of the fuel is produced by the contents of the holder 3. The latter contains a heating element in the form of a tablet-shaped thermistor 8 of ceramic material which has a positive thermal coefficient (so-called PTC material), and a heat sink 9 in the form of a closed box made of good heat-conducting metal and with as low a mass as possible. This box has a spiral peripheral groove 10.

The tablet 8 is fixed to the top side of the box by means of an adhesive which conducts electricity and heat.

By means of two terminals 12, 13, the thermistor is connected to electrical cables 14, 15, which are connected to an electrical voltage supply. Preferably accommodated in the electrical cables is a relay 16 which by means of cable 17 is connected to a thermostatic control unit 18 with a temperature sensor. This sensor ascertains the temperature of the cooling water of the cylinder or measures in some other way a temperature which determines the engine temperature, while the control unit gives signals to the relay 16 to switch off or change the electric current.

The heating device works as follows:

When the engine is cold the relay 16 will be switched in such a way that electric current runs through the electrical circuit 14, 12, 8, 9, 13, 15, so that the thermistor tablet becomes warm. The carefully chosen ceramic PTC material of this tablet at a particular temperature (for example, 80 degrees C.) shows a very steep increase in the electrical resistance, which means that the tablet temperature stabilizes at that temperature and does not become warmer. The heat is transferred to the box 9 (heat sink). The fuel collides with the tablet 8 and flows through the spiral groove 10 on the outer periphery of the box to the injection nozzle 1. During this spiral flow, the fuel is preferably heated to a temperature at which vapour condensation does not take place. This temperature depends on the fuel pressure and composition. Since the tablet does not become warmer than a particular valve selected on the basis of the material composition, vapour condensation in the fuel injector is prevented in a simple manner.

Once the engine is at normal running temperature, the control unit 18 will switch off or reduce the electric current.

The fuel heated when the engine is cold sprays much better than cold fuel. As a result of this, the period during which fuel enrichment is applied can be reduced. All this leads to lower fuel consumption and cleaner exhaust fumes.

It will be clear that the device shown is only one embodiment and that many variations are possible within the scope of the invention.

The heating element could also be fitted some distance away from the injection nozzle 1 in the fuel pipe 4.

Figure 2:
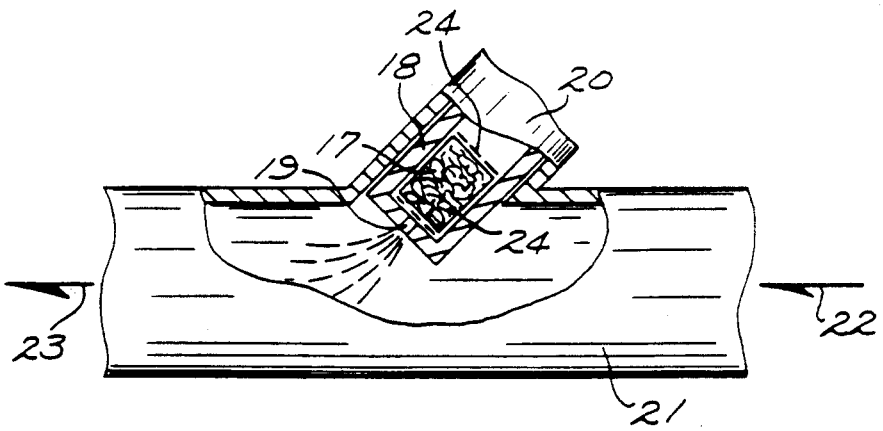
Figure 3:
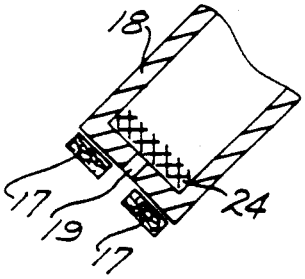
Figure 4:
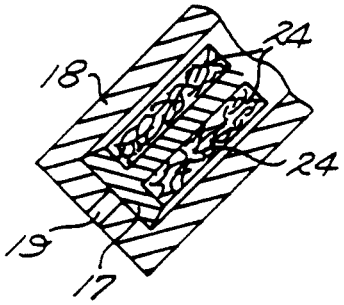

In preferred embodiments as shown in FIGS. 2–4, more accurate temperature control in the injection member is achieved, and there also is achieved improved reaction period after temperature disturbance. For that purpose the heating system consists of PTC material placed at the fuel passage of the injection member.

The application of these measures provides and optimal fuel temperature control and a very reliable operation, as the chance of vapour bubbling or spontaneous ignition of the fuel is minimal because of the fact that the Curie temperature is selected below the spontaneous ignition temperature. In case of the preferred application of heating in the fuel passage the fuel is heated to the desired temperature very quickly and the temperature control is further improved by the direct heat contact. A further acceleration of the fuel heating and improvement of the control is achieved by geometry and arrangement of a PTC element(s) and/or heating bodies (not shown), the heat transferring surface being enlarged very much and an optimal heat economy being achieved. A special example hereof is the application of a porous PTC material. Both the PTC elements and the heating bodies may be of different shapes. The PTC elements may be porous, be constructed as a grate or as a pill.

The heating bodies may consist of an assembly of PTC material and a heat supplying body, or be of honeycomb shape or be porous.

The flow resistance in the PTC material and/or the heating bodies is low, because the fuel slowly passes therethrough.

Referring to FIG. 2, heating member 17, produced from PTC material, which is preferably porous, is positioned at the fuel passage of the injection member 18. The fuel passage has a fuel injection opening 19. The injection member is disposed on a fuel supply line 20 which is connected to an inlet manifold 21, in which fed air 22 is mixed with fuel from the injection member to an air/fuel mixture 23. Upstream and downstream of the PTC material a gauze filter 24 is applied, which may also serve as an electrode.

In the embodiment shown in FIG. 3 the heating member 17 is positioned at the downstream end of the fuel injection 18, to wit on the outer side thereof and about the fuel injection opening 19. In the fuel injection member a filter material 24 is applied.

In the embodiment shown in FIG. 4 the heating member 17 is positioned on the inner side of the fuel injection member. The heating member comprises axial cavities in which filter material 24 is present. Between the heating member 17 and the downstream end of the injection member filter material is applied as well.

Instead of a dense tablet, a lattice-type PTC element or a porous PTC element could also be used, and the fuel flows through this element.

The box 9 can be provided with passages parallel to the central axis, instead of a spriral-shaped passage.

The holder 3 with its contents could be integral with the injection nozzle.

The tablet 8 could be placed between two heat sink boxes.

Flutes or corrugations could be provided in the passage 10 to increase the turbulence.

The scope for applications is also very wide. As regards engines with petrol injection, the system is also suitable for an engine in which the injection valve is not opened by pressure, but by a timed system, in which case there is around the valve stem an electrically operated solenoid which is connected by means of electrical cables to a timing mechanism.

Diesel engines can also be used, of course with such adaptation of the ceramic PTC material that the temperature of the fuel will be higher than the value of around 40 degrees C. which is normal for petrol, since diesel oil is much less volatile.

We claim:

1. Fuel system for a combustion engine having a cylinder with an air inlet passage comprising a fuel spray valve having a fuel injection nozzle for spraying fuel into the cylinder air inlet passage and having a fuel spray valve passage leading to the nozzle, means for mounting the fuel spray valve to position the nozzle to open into the cylinder air inlet passage adjacent the cylinder, a fuel pump for providing fuel under pressure to the fuel spray valve passage to be sprayed from the fuel spray valve nozzle, and a fuel heating device connectable to an electrical power supply and disposed adjacent to the valve to be energized for heating the fuel to enhance finer spraying thereof by the fuel spray valve nozzle, the fuel heating device comprising means defining a spiral fuel flow path of selected length connected to and coaxial with the fuel spray valve passage to dispose said selected length of fuel flow path closely adjacent to the fuel spray valve passage, and a fuel heating element comprising a thermistor of a ceramic material of positive temperature coefficient of resistivity arranged to heat said selected length of the spiral fuel flow path to transfer heat to the fuel flowing in the spiral fuel flow path throughout said selected length of the spiral fuel flow path to substantially heat the fuel at a location closely adjacent to the fuel spray valve passage to enhance vaporizing of fuel being sprayed from the valve nozzle.

2. A fuel system according to claim 1 wherein the fuel spray valve comprises body means defining the fuel spray valve passage leading to the nozzle, and a holder mounts the thermistor to define said selected length of the spiral fuel flow path in connected coaxial relation with the fuel spray valve passage.

3. A fuel system according to claim 2 wherein the thermistor is selected to remain at a temperature below a predetermined value at which fuel vaporization occurs in the fuel passage leading to the nozzle.

4. A fuel system according to claim 3 wherein the thermistor is selected to remain below a temperature on the order of about 80° C. to prevent fuel vaporization in the fuel passage.

5. A fuel system according to claim 4 wherein the thermistor is mounted on a heat-sink to improve heat-transfer from the thermistor to fuel in the spiral fuel flow path.

6. A fuel injector device comprising a fuel spray valve having a fuel spray valve nozzle and a fuel spray valve passage leading to the fuel spray valve nozzle, means defining a spiral flow path of selected length connected to and coaxial with the fuel spray valve passage to dispose said selected length of said fuel flow path adjacent to the fuel spray valve passage, and a fuel heating element comprising a thermistor of a ceramic material of positive temperature coefficient of resistivity arranged to heat said selected length of the spiral fuel flow path to transfer heat to the fuel flowing in the spiral fuel flow path throughout said selected length of the spiral fuel flow path to substantially heat the fuel at a location closely adjacent to the fuel spray valve passage to enhance vaporizing of fuel being sprayed from the valve nozzle.

7. A fuel injector device as set forth in claim 6 wherein the fuel spray valve comprises body means defining the fuel spray valve passage leading to the fuel spray valve nozzle and a holder mounts the thermistor to define said selected length of the spiral fuel flow path in connected coaxial relation with the fuel spray valve passage.

8. A fuel system according to claim 7 wherein the thermistor is selected to remain at a temperature below a predetermined value at which fuel vaporization occurs in the fuel passage reading to the nozzle.

9. A fuel system according to claim 8 wherein the thermistor is selected to remain below a temperature on the order of about 80° C. to prevent fuel vaporization in the fuel passage.

10. A fuel system according to claim 9 wherein the thermistor is mounted on a heat-sink to improve heat-transfer from the thermistor to fuel in the spiral fuel flow path.

* * * * *